US007086387B2

(12) United States Patent
Okamoto et al.

(10) Patent No.: US 7,086,387 B2
(45) Date of Patent: Aug. 8, 2006

(54) CONTROL APPARATUS OF INTERNAL COMBUSTION ENGINE

(75) Inventors: Takashi Okamoto, Hitachinaka (JP); Toshio Hori, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 40 days.

(21) Appl. No.: 10/912,067

(22) Filed: Aug. 6, 2004

(65) Prior Publication Data

US 2005/0005905 A1 Jan. 13, 2005

Related U.S. Application Data

(63) Continuation of application No. 10/084,069, filed on Feb. 28, 2002, now abandoned.

(30) Foreign Application Priority Data

Jun. 1, 2001 (JP) ..... 2001-166322

(51) Int. Cl.
*F02D 41/04* (2006.01)
*F02D 17/02* (2006.01)

(52) U.S. Cl. ..... 123/481; 123/493; 123/198 F

(58) Field of Classification Search ..... 123/198 F, 123/90.15, 90.16, 350, 406.23, 406.24, 406.25, 123/436, 481, 492, 493, 295, 430; 701/112
See application file for complete search history.

(56) References Cited

U.S. PATENT DOCUMENTS 4,535,744 A * 8/1985 Matsumura ..... 123/493
5,099,814 A 3/1992 Ament
5,479,898 A 1/1996 Cullen et al.
5,483,941 A 1/1996 Cullen et al.
5,579,736 A * 12/1996 Nakamura et al. ..... 123/481
5,623,906 A 4/1997 Storhok
5,685,277 A 11/1997 Pallett et al.
5,797,371 A * 8/1998 Nonaka ..... 123/481
5,845,492 A 12/1998 Isobe et al.
5,857,445 A * 1/1999 Shimada et al. ..... 123/492
5,975,052 A 11/1999 Moyer
6,061,621 A 5/2000 Sasaki
6,390,057 B1 * 5/2002 Yoshizawa et al. ..... 123/295
6,499,449 B1 * 12/2002 Michelini et al. ..... 123/481
6,516,782 B1 2/2003 Thomas
6,546,910 B1 4/2003 Tanaka et al.

(Continued)

FOREIGN PATENT DOCUMENTS

JP 60093153 A * 5/1985 ..... 123/481

(Continued)

OTHER PUBLICATIONS

European Search Report dated Dec. 12, 2005.

*Primary Examiner*—Willis R. Wolfe, Jr.
(74) *Attorney, Agent, or Firm*—Crowell & Moring LLP

(57) ABSTRACT

The invention provides a control apparatus of a cylinder injection of fuel type internal combustion engine executing a dilute combustion, which can satisfy a requirement of rapidly changing an engine torque while restricting a deterioration of a driving property and an exhaust gas as much as possible. In a control apparatus of a multicylinder engine executing a dilute combustion, in the case that a requirement of reducing and changing an engine torque of the internal combustion engine is applied, the control apparatus executes a fuel cut of a predetermined number of cylinders, and controls so that a torque of operating cylinders except the cylinders executing the fuel cut becomes the required engine torque.

22 Claims, 14 Drawing Sheets

U.S. PATENT DOCUMENTS

2002/0162540 A1* 11/2002 Matthews et al. ..... 123/481

FOREIGN PATENT DOCUMENTS

JP 04298658 A * 10/1992 ..... 123/481
JP 09144830 A * 6/1997 ..... 123/436
JP 10-061476 3/1998
JP 11-324748 11/1999
JP 2000-120481 4/2000

* cited by examiner

CONTROL APPARATUS OF INTERNAL COMBUSTION ENGINE

BACKGROUND OF THE INVENTION

1. Field of the Invention

The present invention relates to a control apparatus of an internal combustion engine mounted to a motor vehicle or the like, and more particularly to a control apparatus of an internal combustion engine which can be preferably applied to a requirement of reducing an engine torque and can execute a combustion at a dilute air fuel ratio.

2. Description of the Prior Art

In recent years, in an internal combustion engine mounted to a vehicle or the like, in view of problems such as an environmental problem, a reduction of fuel consumption and the like, an attention is paid to a lean burn cylinder injection of fuel type internal combustion engine which burns by increasing an air fuel ratio so as to make a fuel dilute. Further, in the lean burn cylinder injection of fuel type internal combustion engine mounted to the vehicle or the like as mentioned above, there is a case that an output reduction control is required in the internal combustion engine for a gear change time at which an operating state of the vehicle is changed, and there have been proposed various kinds of control apparatuses of the internal combustion engine executing a combustion control suitable for the requirement.

For example, a control apparatus of a cylinder injection of fuel type internal combustion engine described in JP-A-2000-120481 is structured such as to reduce a fuel injection amount and make an air fuel ratio lean, thereby restricting an output property of the internal combustion engine in the case that the internal combustion engine is in a compression lean mode state at a time when an output reduction requirement is applied, and to reduce the fuel injection amount and delay an ignition timing, thereby restricting the output property of the internal combustion engine in the case that it is in a non-compression lean mode state.

Further, a control apparatus of an internal combustion engine described in JP-A-10-61476 is structured such that in the internal combustion engine capable of burning at a dilute air fuel ratio by stratifying a fuel supplied to a combustion chamber, the control apparatus controlling the combustion thereof can rapidly and with an improved response reduce an engine torque in correspondence to a requirement of reducing the engine torque by synchronously compensating (phase lag controlling) a fuel injection timing and an ignition timing, when the requirement of reducing the engine torque is applied.

Further, a control apparatus of an internal combustion engine described in JP-A-11-324748 is provided with a torque control means for executing a fuel cut of an optional cylinder so as to limit a number of operating cylinders at a time when an output torque down of the internal combustion engine is required, compensating so as to increase an amount of fuel supplied to the operating cylinders, thereby compensating an air fuel ratio of an air-fuel mixture to a rich side, preventing the air-fuel ratio from becoming equal to or more than a predetermined value, and increasing and reducing various kinds of control amount (the ignition timing or the like) for controlling an operation state of the internal combustion engine so that an actual output torque becomes a required torque.

In this case, in the method of changing the torque by making the air-fuel ratio lean such as the control apparatus of the internal combustion engine as described in JP-A-2000-120481, in the case of intending to improve a specific fuel consumption by the dilute air-fuel mixture combustion, the air fuel ratio is set to a lean state near a combustion stabilization limit, as shown in FIG. 11. At this time, when reducing the fuel supply amount so as to make lean, for the purpose of reducing the torque, it is over the combustion stabilization limit, so that the combustion is deteriorated, further a misfire is sometimes generated, and there is a case that a deterioration of driving property and exhaust gas is generated. Further, in the case of making the air fuel ratio lean so as not to be over the combustion stabilization limit by taking this into consideration, there is generated a problem that a margin for making lean is not sufficient and the torque can not be changed to the required engine torque in some cases.

Further, the control apparatus of the internal combustion engine described in JP-A-10-61476 is structured such as to reduce the engine torque by controlling the ignition timing and the injection timing by way of the phase lag, however, in the control mentioned above, as is different from the matter that the combustion on the basis of a theoretical air fuel ratio has a feature that an ignition timing changing range is wide as shown in FIG. 13A, a compatible range between the ignition timing and the injection timing capable of obtaining the stable combustion is narrow at a time of a dilute combustion time (particularly at a stratified combustion time) as shown in FIG. 13B. Accordingly, in the case of deflecting from the range, the deterioration of the combustion and by extension the misfire are sometimes generated in the same manner, so that a problem that the driving property and the exhaust gas are deteriorated is generated. Further, in the case of making so as not to deflect from the compatible range with taking this into consideration, there is a case that the margin for the phase lag of the ignition timing and the injection timing is not sufficient and the torque can not be changed to the required engine torque.

Further, the control apparatus of the internal combustion engine described in JP-A-11-324748 is structured such as to execute the fuel cut of the optional cylinder so as to limit the number of the operating cylinders at a time when the output torque down of the internal combustion engine is required, however, is structured such as to compensate so as to increase the amount of the fuel supplied to the operating cylinders, thereby compensating the air fuel ratio of the air-fuel mixture to the rich side, for the purpose of restricting an emission deterioration at the same time of the fuel cut of the cylinder, and to prevent the air fuel ratio from becoming equal to or more than the predetermined value for the purpose of restricting the misfire of the operating cylinders by compensating the air fuel ratio to the rich side, so that there is a problem that an accurate torque control of the internal combustion engine can not be executed in the dilute combustion state at the required torque value.

SUMMARY OF THE INVENTION

The present invention is made by taking the problems mentioned above into consideration, and an object of the present invention is to provide a control apparatus of a cylinder injection of fuel type internal combustion engine executing a dilute combustion, which can satisfy a requirement of accurately and rapidly changing an engine torque while restricting a deterioration of a driving property and an exhaust gas as much as possible.

In order to achieve the object mentioned above, in accordance with the present invention, there is provided a control apparatus of an internal combustion engine comprising a control apparatus of a multicylinder engine executing a dilute combustion, wherein in the case that a requirement of reducing and changing an engine torque of the internal combustion engine is applied, the control apparatus executes a fuel cut of a predetermined number of cylinders, and controls so that a torque of operating cylinders except the cylinders executing the fuel cut becomes the required engine torque.

In accordance with a preferable particular aspect of the present invention, there is provided a control apparatus of an internal combustion engine characterized in that the number of the cylinders in which the fuel is cut is determined on the basis of a degree requirement at which the engine torque is reduced and changed, and the torque control of the operating cylinders is characterized by increasing and reducing the torque on the basis of the number of the cylinders in which the fuel cut is executed, and the required engine torque.

The control apparatus of the internal combustion engine in accordance with the present invention structure in the manner mentioned above, can satisfy a requirement of rapidly changing the torque and can execute an accurate torque control while restricting a deterioration of a driving property and an exhaust gas as much as possible, in the internal combustion engine executing the dilute combustion.

Further, in accordance with another preferable particular aspect of the present invention, there is provided a control apparatus of an internal combustion engine characterized in that the control apparatus is provided with a roughly estimating means for roughly estimating the number of the cylinders in which the fuel cut is executed on the basis of a required value for reducing and changing the engine torque and an engine torque value before the reduction requirement is applied, a judging means for judging whether or not the number of the cylinders is an integral number and a computing means for computing the number of the cylinders in which the fuel is cut corresponding to an integral number value in the case that the judged number of the cylinders is not an integral number, the computing means for computing the number of the cylinders in which the fuel is cut computes the number of the cylinders on the basis of the number of the cylinders roughly estimated by the cylinder number roughly estimating means or computes the number of the cylinders on the detected air fuel ratio, and a torque control means for controlling the torque of the operating cylinders is provided.

Further, in accordance with the other preferable particular aspect of the present invention, there is provided a control apparatus of an internal combustion engine characterized in that the torque control means for controlling the torque of the operating cylinders changes and controls at least one of a fuel supply amount, a fuel injection timing and an ignition timing of the operating cylinders, the fuel supply amount in the operating cylinders is limited on the basis of the air fuel ratio, and the fuel cut of the predetermined number of cylinders and the torque of the operating cylinders are controlled during a period for which combustion and expansion strokes of the respective cylinders pass through all the cylinders.

Further, in accordance with the other preferable particular aspect of the present invention, there is provided a control apparatus of an internal combustion engine characterized in that the reduction and change of the engine torque is executed on the basis of information applied from an external portion except the internal combustion engine, executed on the basis of information computed in the control apparatus, or executed on the basis of the information applied from the external portion except the internal combustion engine and the information computed within the control apparatus.

Other objects, features and advantages of the invention will become apparent from the following description of the embodiments of the invention taken in conjunction with the accompanying drawings.

DESCRIPTION OF THE PREFERRED EMBODIMENTS

A description will be given below of an embodiment of a control apparatus of an internal combustion engine in accordance with the present invention with reference to the accompanying drawings.

Figure 1:
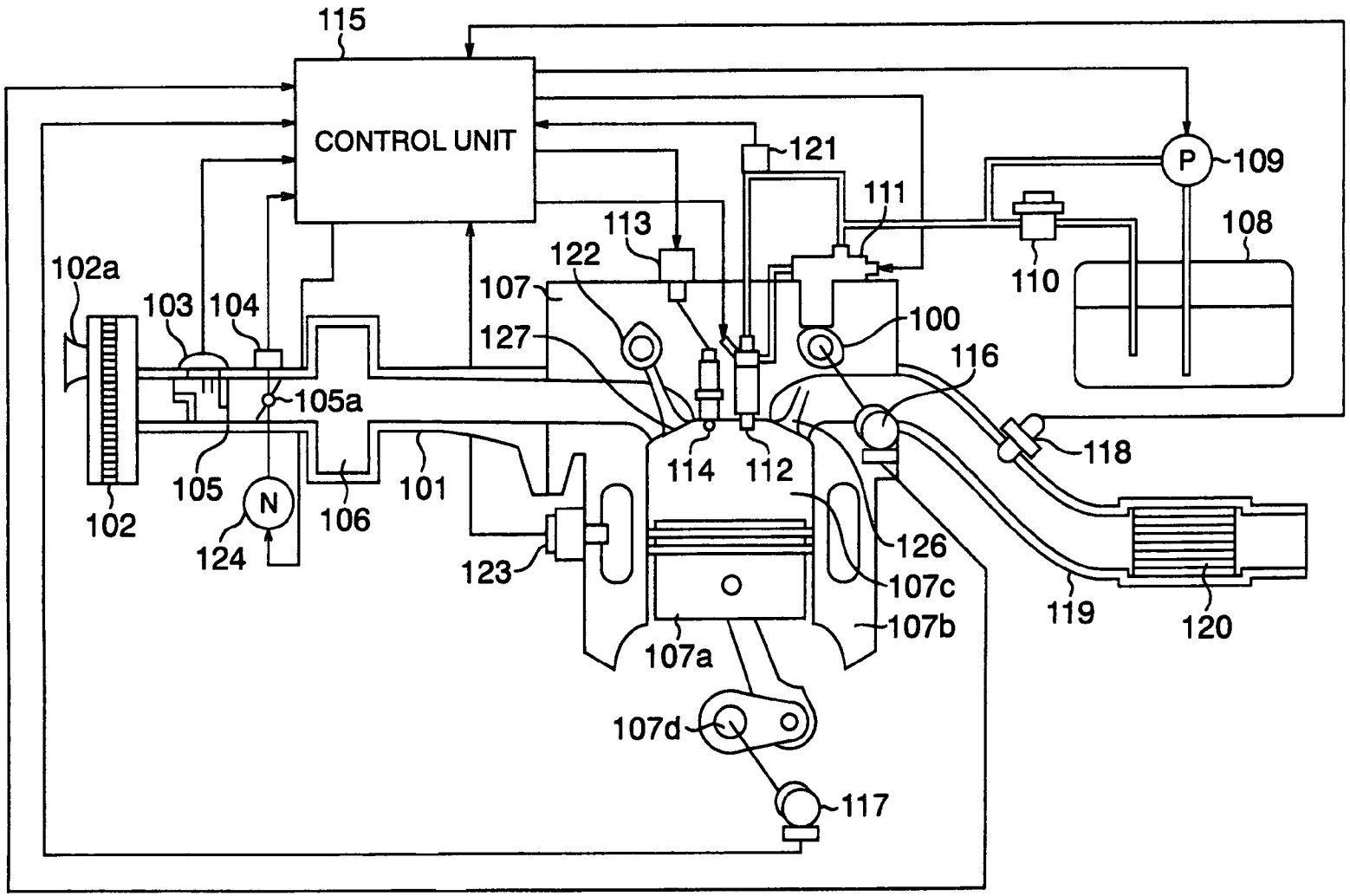
FIG. 1 is a view of a whole structure of a control system in an internal combustion engine, showing an embodiment of a control apparatus of the internal combustion engine in accordance with the present invention.

FIG. 1 shows a whole structure in a control system of a cylinder injection of fuel type internal combustion engine 107 in accordance with the present embodiment. An intake air introduced into a cylinder 107*b* is taken into from an inlet portion 102*a* of an air cleaner 102, passes through an air flow meter (an air flow sensor) 103 corresponding to one of internal combustion engine operating state measuring means, and enter into a collector 106 through a throttle body 105 in which an electrically controlled throttle valve 105*a* for controlling an intake air flow amount is received. The air sucked into the collector 106 is distributed into respective intake pipes 101 connected to respective cylinders 107*b* of the internal combustion engine 107 and thereafter introduced to combustion chambers 107*c* formed by pistons 107*a*, the cylinders 107*b* and the like.

Further, a signal expressing the intake flow amount is output from the air flow sensor 103 to a control unit 115 corresponding to a control apparatus of the internal combustion engine 107. Further, a throttle sensor 104 corresponding to one of operating state measuring means of the internal combustion engine, which detects an opening degree of the electrically controlled throttle valve 105*a* is mounted to the throttle body 105, and the structure is made such that a signal thereof is output to the control unit 115.

On the contrary, a fuel such as a gasoline or the like is primarily pressurized by a fuel pump 109 from a fuel tank 108 so as to be adjusted in pressure to a fixed pressure by a fuel pressure regulator 110, and is secondarily pressurized by a high pressure fuel pump 111 so as to be pressure fed to a common rail connected to an injector 112.

The high pressure fuel pressure fed to the common rail is injected to the combustion chamber 107*c* from the injector 112 provided in each of the cylinders 107*b*. The fuel injected to the combustion chamber 107*c* is ignited by an ignition plug 114 in accordance with an ignition signal which is made in a high electric voltage by an ignition coil 113.

Further, a cam angle sensor 116 mounted to a cam shaft of an exhaust valve 126 outputs a signal for detecting a phase of the cam shaft to the control unit 115. In this case, the cam angle sensor 116 may be mounted to the cam shaft in a side of an intake valve 127. Further, a crank angle sensor 117 is provided on a shaft of a crank shaft 107*d* for detecting a rotation and a phase of the crank shaft 107*d* of the internal combustion engine, and an output thereof is input to the control unit 115.

Further, an air fuel ratio sensor 118 provided in an upstream side of a catalyst 120 within an exhaust pipe 119 detects an air fuel ratio of an exhaust gas, and outputs a detected signal thereof to the control unit 115.

Figure 2:
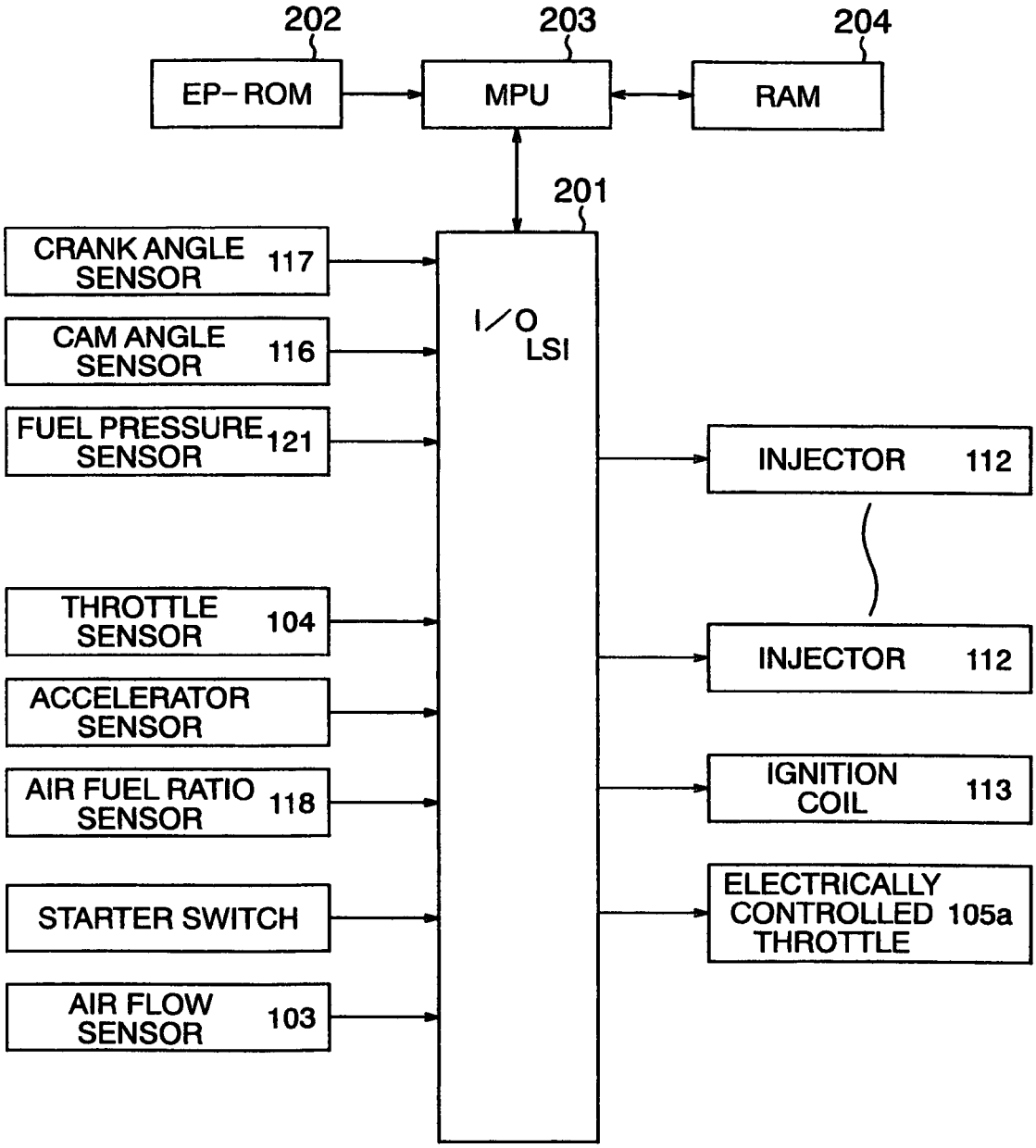
FIG. 2 is a view of an internal structure of the control apparatus in the internal combustion engine.

FIG. 2 shows a main portion of the control unit 115. The control unit 115 is constituted by an MPU 203, a ROM 202, a RAM 204, an I/O LSI 201 including an A/D converter and the like, takes in signals from the air flow sensor 103 corresponding to one of measuring means for measuring (detecting) the operation state of the internal combustion engine, various kinds of sensors including a fuel pressure sensor 121 and the like as an input, executes a predetermined computing process, outputs various kinds of control signals determined as the computed results, and supplies a predetermined control signal to the respective injectors 112, the injection coils 113 and the like so as to execute a fuel supply amount control and an ignition timing control.

In the case that the internal combustion engine 107 mentioned above is mounted on a vehicle such as a motor vehicle or the like, there is generated in some cases a requirement of rapidly changing a torque of the engine to a target torque, at a time of controlling a motion of the vehicle for the purpose of securing a traveling stability of the vehicle or the like. The control apparatus of the internal combustion engine in accordance with the present embodiment executes a fuel cut of a specific cylinder so as to serve as a torque reduction means for rapidly reducing a torque to a required engine torque while keeping the internal combustion engine 107 in a dilute combustion, and increases the torque in the other operating cylinders.

Figure 3:
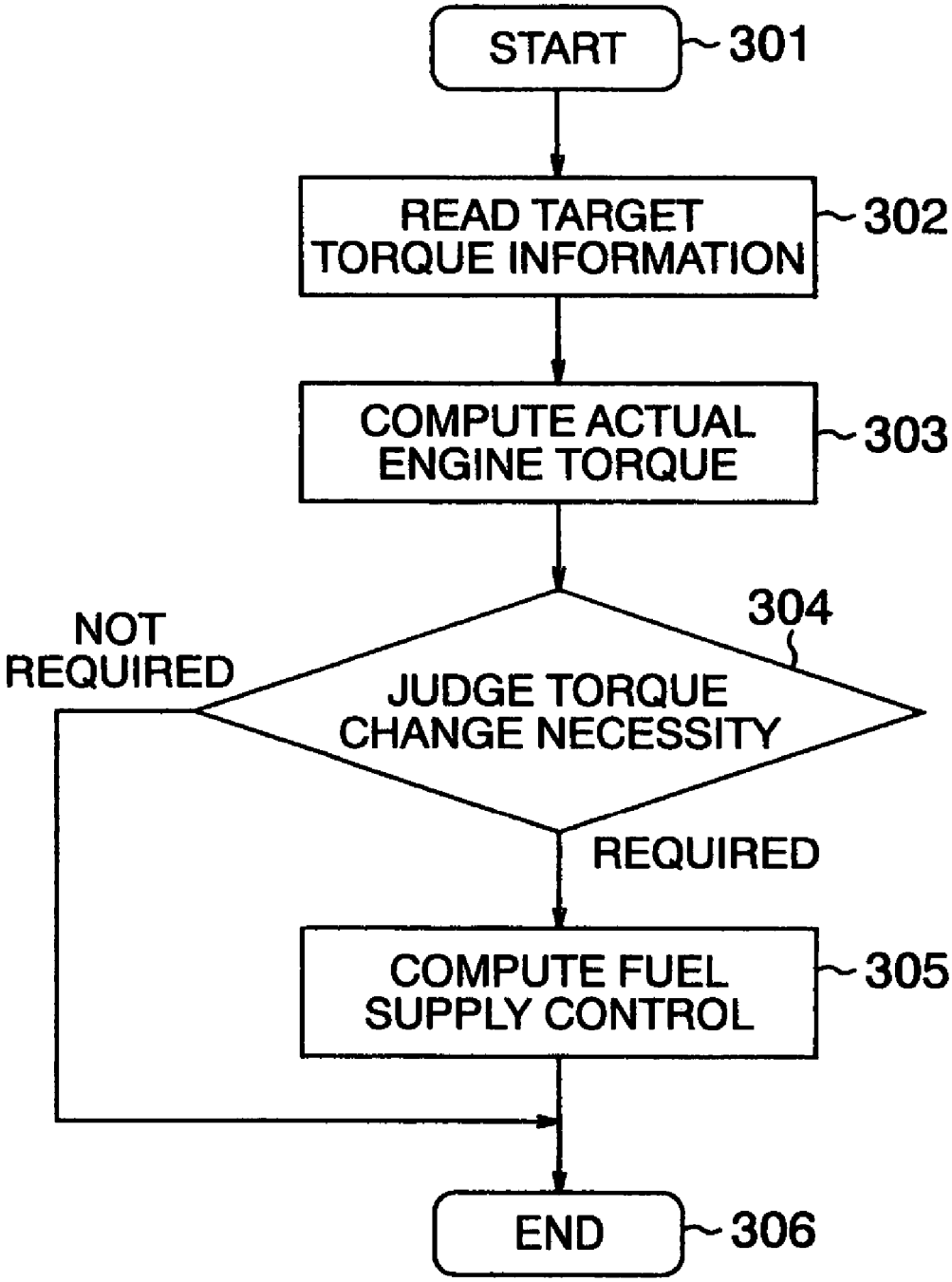
FIG. 3 is a control flow chart of a first embodiment of the control apparatus in the internal combustion engine in accordance with the present invention.

FIG. 3 shows a control flow chart of the control apparatus of the internal combustion engine in accordance with a first embodiment of the present invention, corresponding to a flow chart of respective processes until the control apparatus 115 of the internal combustion engine computes the fuel supply control, in the case that the engine torque reduction requirement is applied to the internal combustion engine 107 in correspondence to the operating state of the vehicle.

The processes are executed at every predetermined times, and in a step 302, the engine torque reduction requirement output from the vehicle is read in the control apparatus 115. The engine torque reduction requirement may be constituted by a requirement computed from the information input within the control apparatus 115, or may be a requirement computed on the bases of the information computed by the other control units and the information input within the control apparatus 115. An effect of reducing a computing load of the present control apparatus 115 can be obtained by computing the engine torque reduction requirement by the other control units.

In a step 303, a present engine torque of the internal combustion engine is computed on the basis of information relating to the operating state of the internal combustion engine such as a rotational number of the internal combustion engine, a fuel injection amount and the like. In a step 304, a necessity of torque change is judged on the basis of a relation of magnitude between the required engine torque and the present engine torque, a reliability of the computed value and the like. In the case that it is judged that the torque change is "not required", the flow is finished while maintaining the current state of the internal combustion engine. Further, in the case that it is judged that the torque change is "required", the step goes to a step 305, and the computation for the fuel supply control is executed in the step 305.

Figure 4:
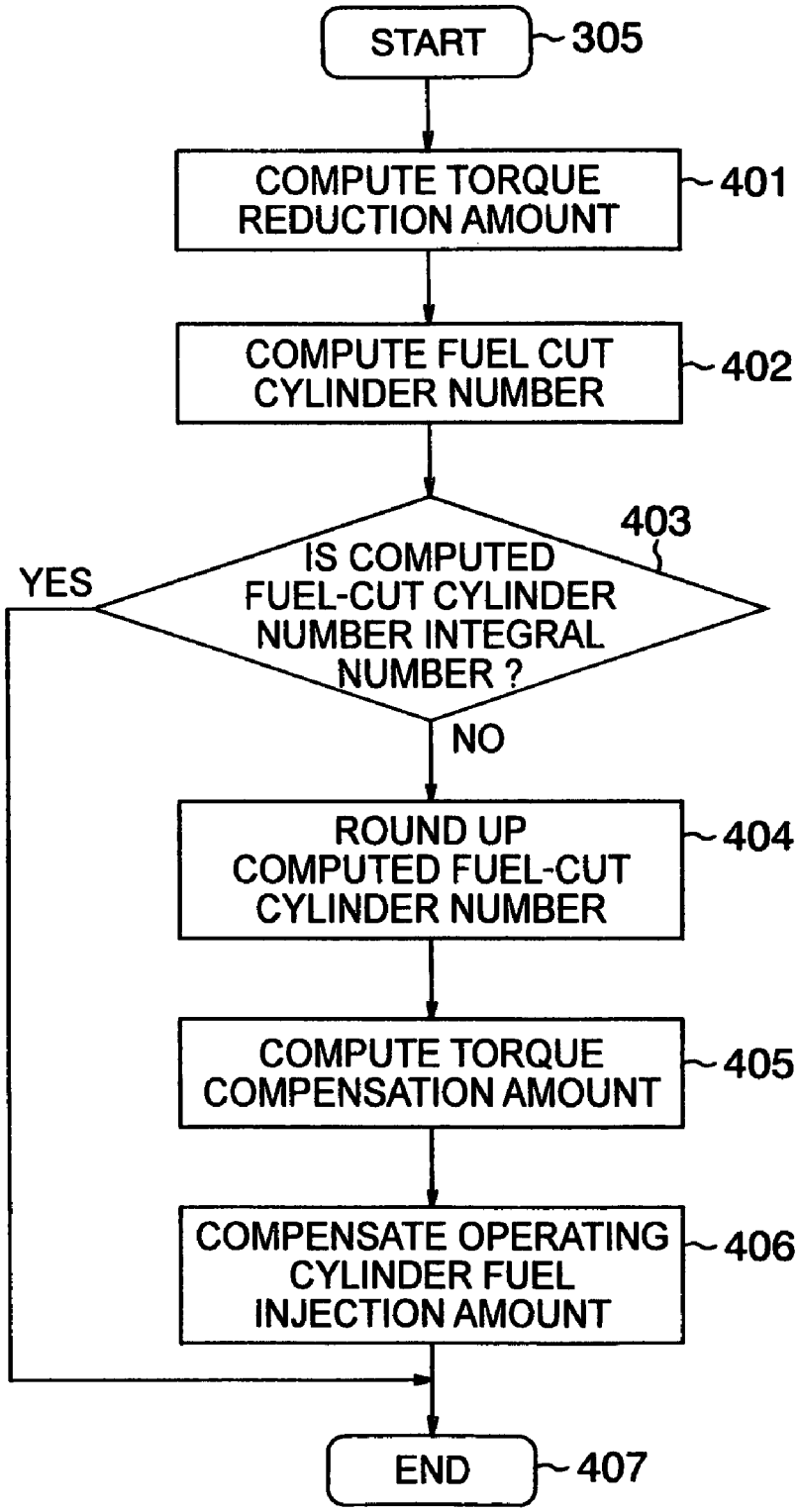
FIG. 4 is a particular control flow chart of a fuel supply control in a step 305 of the control flow chart in FIG. 3.

FIG. 4 shows a control flow chart of the fuel supply control in the control apparatus of the internal combustion engine in accordance with the present embodiment, and describes a particular and detailed control flow chart of the fuel supply control in the step 305 of the control flow chart in FIG. 3.

In a step 401, a torque change value is computed on the basis of the required engine torque computed in the step 302 in FIG. 3 and the present engine torque computed in the step 303. In this case, the computed value may be a torque change rate corresponding to a ratio between the required engine torque and the present engine torque.

Figure 12:
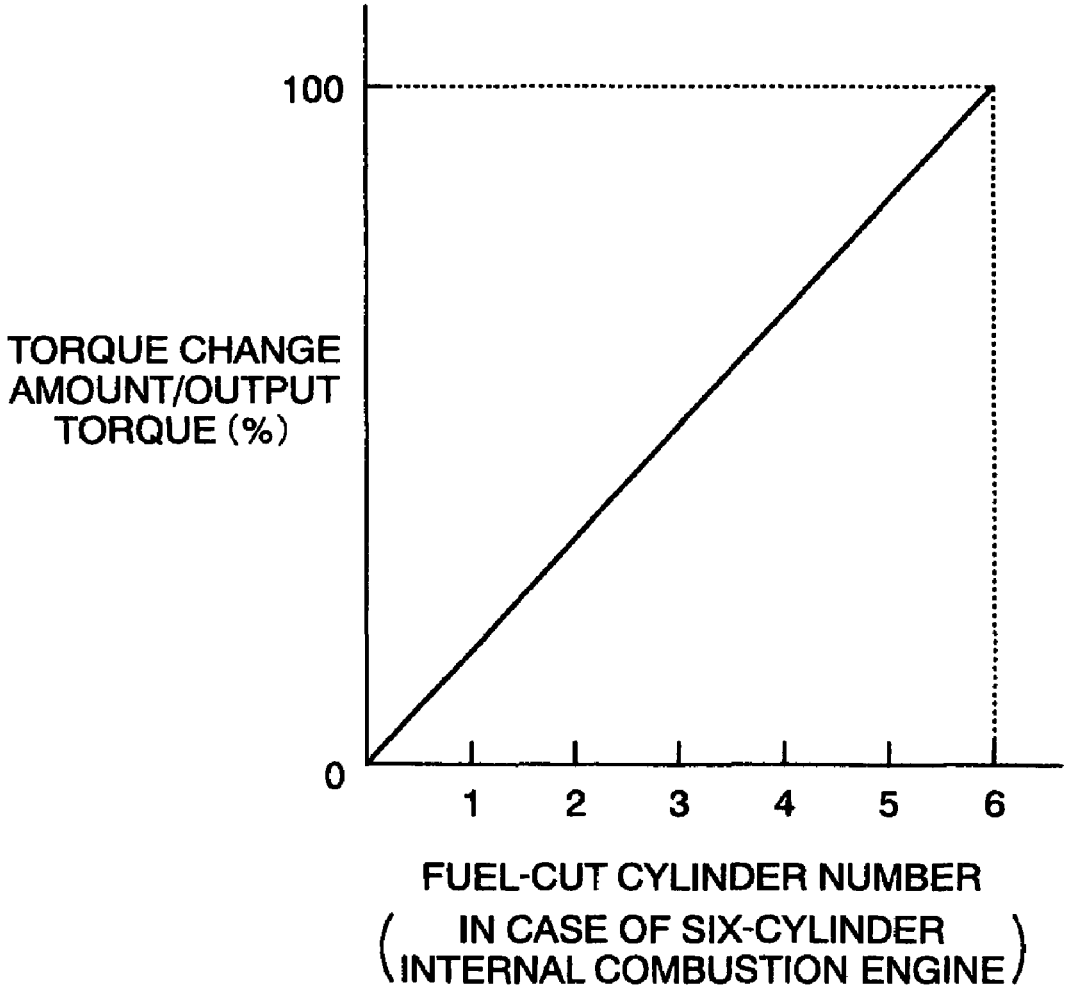
FIG. 12 is a view showing a relation between a ratio between a torque change value and a present engine torque, and a fuel-cut cylinder number.
Figure 13A:
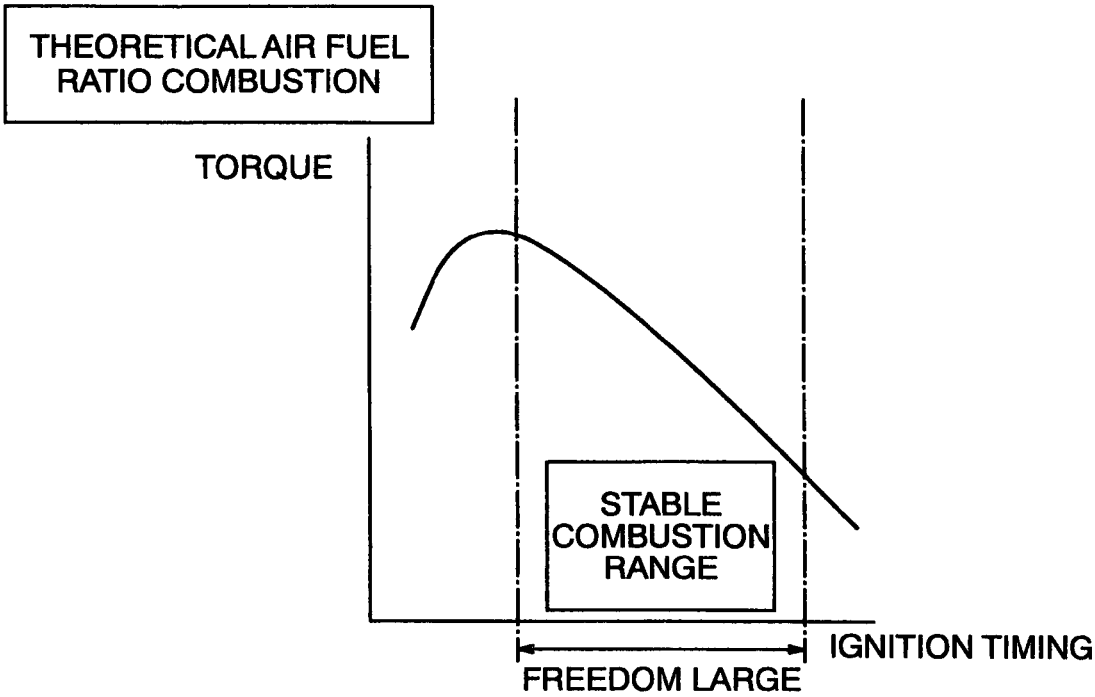
FIG. 13 is a view showing stable combustion ranges in a combustion on the basis of a theoretical air fuel ratio and the stratified combustion.
Figure 13B:
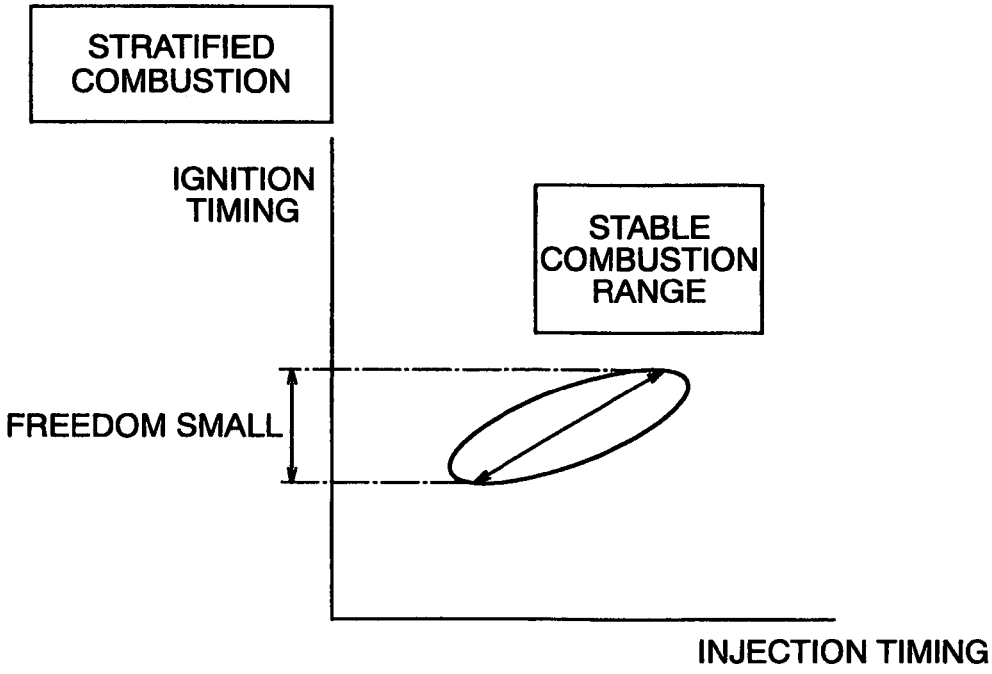

In a step 402, a number of fuel cut cylinders executed during a period for which combustion and expansion strokes of the respective cylinders in the engine pass through all the cylinders is computed on the basis of the ratio between the torque change value and the present engine torque. A relation between the ratio between the torque change value and the present engine torque and the number of the fuel cut cylinders is shown in FIG. 12. In the case of actually executing the fuel cut, only an integral number of cylinders can be executed, however, in the computed value in a block 402, a decimal number may be left in the case that the decimal number is output.

In a step 403, it is judged whether or not the computed number of the fuel cut cylinders is an integral number, and if it is an integral number, the control flow is finished, and if it is not an integral number, the step goes to a step 404. In the step 404, in the case that the computed fuel cut cylinder number is a value corresponding to an integral number, a round-up of the value is executed, and the round-up number is set to the fuel cut cylinder number. An idea here is executing the integral number of fuel cut is executed, the integral number being larger than the computed value in the step 402.

In a step 405, a torque compensation amount for achieving a target torque is computed on the basis of the required engine torque computed in the step 302 in FIG. 3 and the torque at a time when the fuel cut at the cylinder number computed in the step 404 is executed. In a step 406, a fuel injection amount in the operating cylinder for satisfying the torque compensation amount is computed, whereby the fuel is increased. In this case, as a method of increasing the torque of the operating cylinder for satisfying the torque compensation amount, in addition to the method of increasing the fuel supply amount, there can be considered a method of spark advancing an ignition timing and/or an injection timing for increasing an ignition power and improving a combustion efficiency, and the like. Further, there is a method of increasing the engine torque so as to satisfy the required engine torque by satisfying the torque compensation amount by means of an external apparatus such as a motor or the like.

Figure 5:
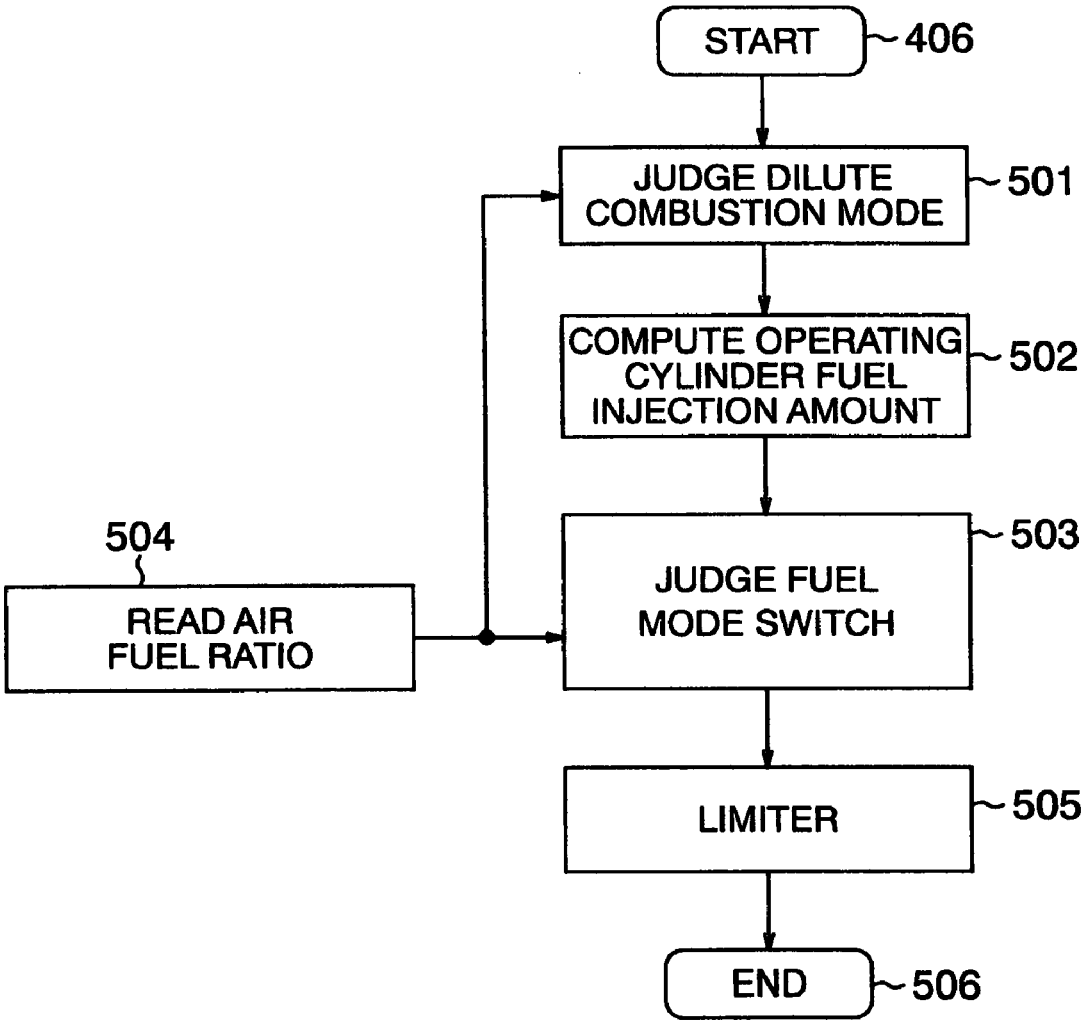
FIG. 5 is a particular control flow chart of an operating cylinder fuel injection amount compensation in a step 406 of the control flow chart in FIG. 4.

FIG. 5 is a control flow chart of the fuel supply control in the control apparatus of the internal combustion engine in accordance with the present embodiment, which describes a particular and detailed control flow chart of the operating cylinder fuel injection amount compensation in the step 406 of the control flow chart in FIG. 4.

In a step 501, it is judged on the basis of the value of the air fuel ratio sensor, the fuel injection amount and the like whether or not the present combustion state is a dilute combustion. In the case that it is judged that it is in the dilute combustion state, the step goes to a step 502. In the step 502, the fuel supply amount which can satisfy the torque compensation amount computed in the step 405 in FIG. 4 is computed.

Figure 6:
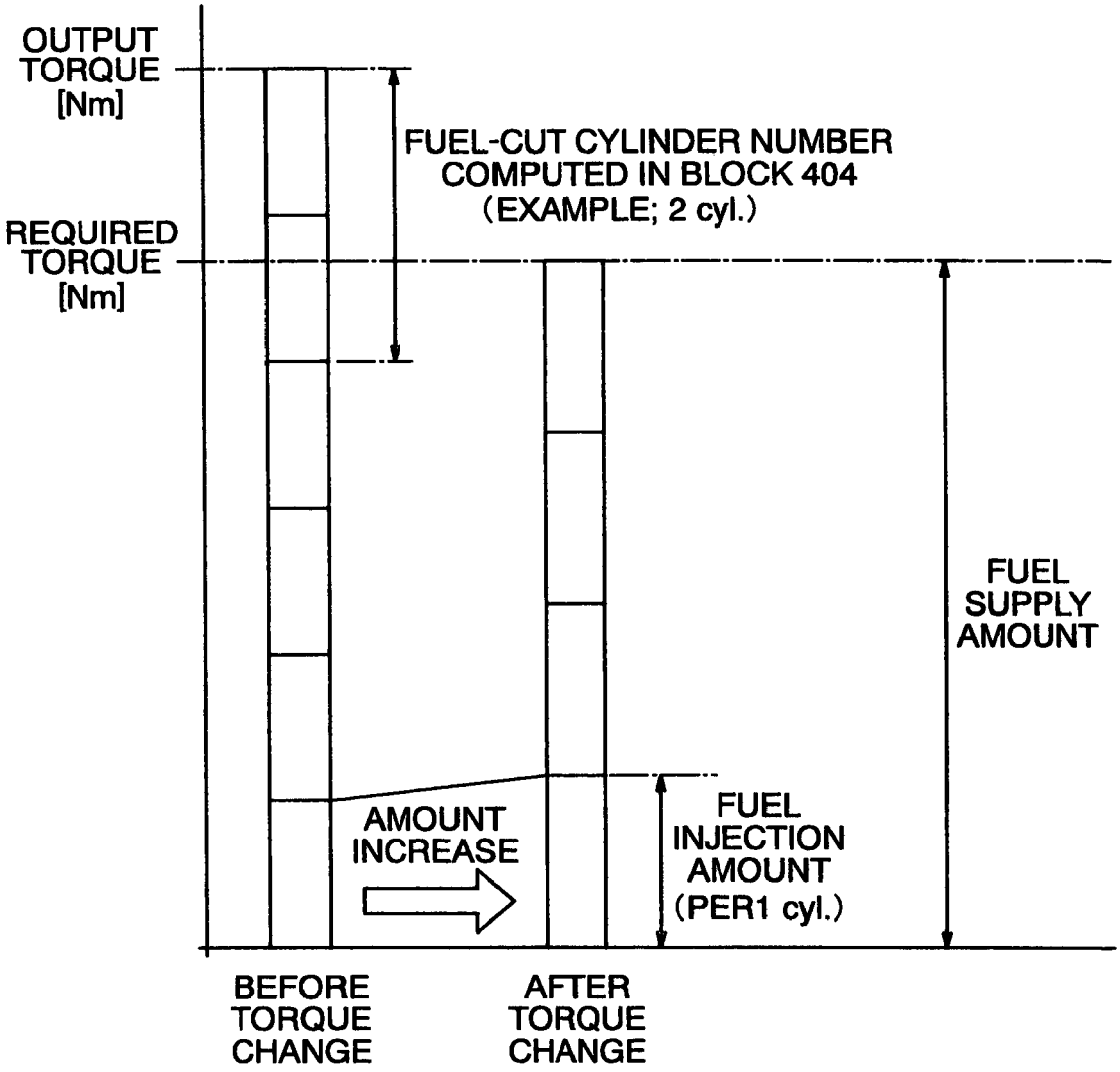
FIG. 6 is a view showing an example in the case that a number of the fuel-cut cylinders computed for the purpose of satisfying a required torque is two cylinders, in a six-cylinder internal combustion engine in the control apparatus of the internal combustion engine shown in FIG. 3.

FIG. 6 shows an example in the case that the fuel cut cylinder number computed in the step 404 for satisfying the required torque is two cylinders, in the six-cylinder internal combustion engine. In general, since the engine torque is determined by the fuel supply amount, it is possible to determine the fuel supply amount from the torque compensation amount. By determining the fuel supply amount to the internal combustion engine, an increased amount of fuel per one cylinder is also computed. In this case, there is shown the example in which the fuel supply amount is computed on the basis of the torque, however, there exists an idea that the fuel supply amount is determined by the operating state of the internal combustion engine.

In a step 503, a fuel mode switching is judged. A combustion mode of the internal combustion engine includes a stoichiometric combustion mode in which the fuel is injected during an intake stroke and a premix combustion is executed on the basis of a theoretical air fuel ratio, a homogeneous lean combustion mode in which the fuel is injected mainly during the intake stroke and the premix combustion is executed on the basis of an air fuel ratio leaner than the theoretical air fuel ratio, and a stratified combustion mode in which the fuel is injected mainly during a compression stroke and a stratified combustion is executed on the basis of an air fuel ratio leaner than the homogeneous lean combustion.

For example, in the case that the internal combustion engine is under the stratified combustion mode, in the case that it is judged on the basis of the information such as the fuel injection amount or the like that it is over the combustion stabilization limit in the rich side at a time of executing the fuel amount increase, the mode is switched to the homogeneous lean combustion mode by changing the fuel injection timing and the ignition timing. Accordingly, it is possible to further expand the combustion stability limit in the case of increasing the amount of the fuel, and it is possible to increase the margin for changing the torque.

In a step 505, in the case that it is judged on the basis of the information such as the fuel injection amount or the like that it is over the combustion stability limit in the rich side of the engine at a time of executing the fuel amount increase, the fuel injection amount is limited so as not to be over the combustion stability limit.

Figure 7:
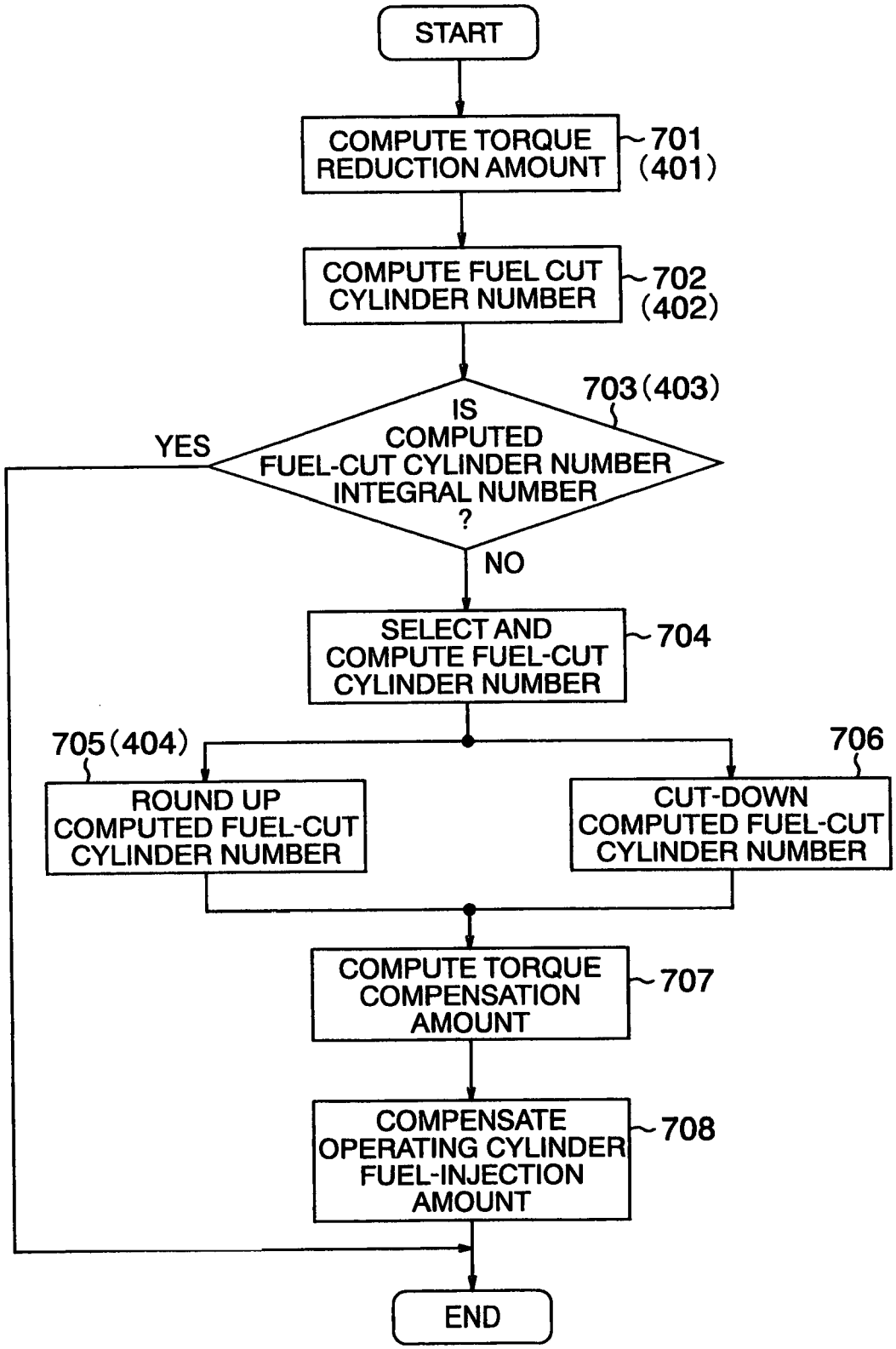
FIG. 7 is a control flow chart of a control apparatus in an internal combustion engine in accordance with a second embodiment of the present invention, corresponding to a control flow chart for a fuel supply control.

FIG. 7 shows a control flow chart of a control apparatus of an internal combustion engine in accordance with a second embodiment of the present invention, which is obtained by partly changing the control flow of the fuel supply control in accordance with the first embodiment in FIG. 4.

In a step 701 (401), a torque change value is computed on the basis of the required engine torque computed in the step 302 in FIG. 3 and the present engine torque computed in the step 303. In a step 702 (402), a number of fuel cut cylinders is computed (roughly estimated) on the basis of the ratio between the torque change value and the present engine torque. In the case that the computed (roughly estimated) fuel cut cylinder number is not an integral number, the step goes to a step 704. In the step 704, it is selected whether the fuel cut cylinder number computed in the step 702 (402) is rounded up or cut down.

In steps 705 (404) and 706, the round-up or the cut-down of the value of the computed fuel cut cylinder number which does not become an integral number is executed, and the round-up or cut-down value is set to the fuel cut cylinder number.

In a step 707, a torque compensation amount for achieving a target torque is computed on the basis of the required engine torque computed in the step 302 in FIG. 3 and the torque in the case that the fuel cut at the cylinder number computed in the step 705 (404) or the step 706 is executed. In a step 708, a fuel injection amount in the operating cylinder for satisfying the torque compensation amount is computed.

In the step 704, as shown in FIG. 19, in the case of rounding up the fuel cut cylinder number computed in the step 702 (402), since it is below the required engine torque as it is, the fuel injection amount in the operating cylinders is increased as shown in FIG. 5.

Further, in the step 704, in the case of cutting down the fuel cut cylinder number computed in the step 702 (402), since it is over the required engine torque as it is, the fuel amount in the operating cylinders is reduced.

Figure 11:
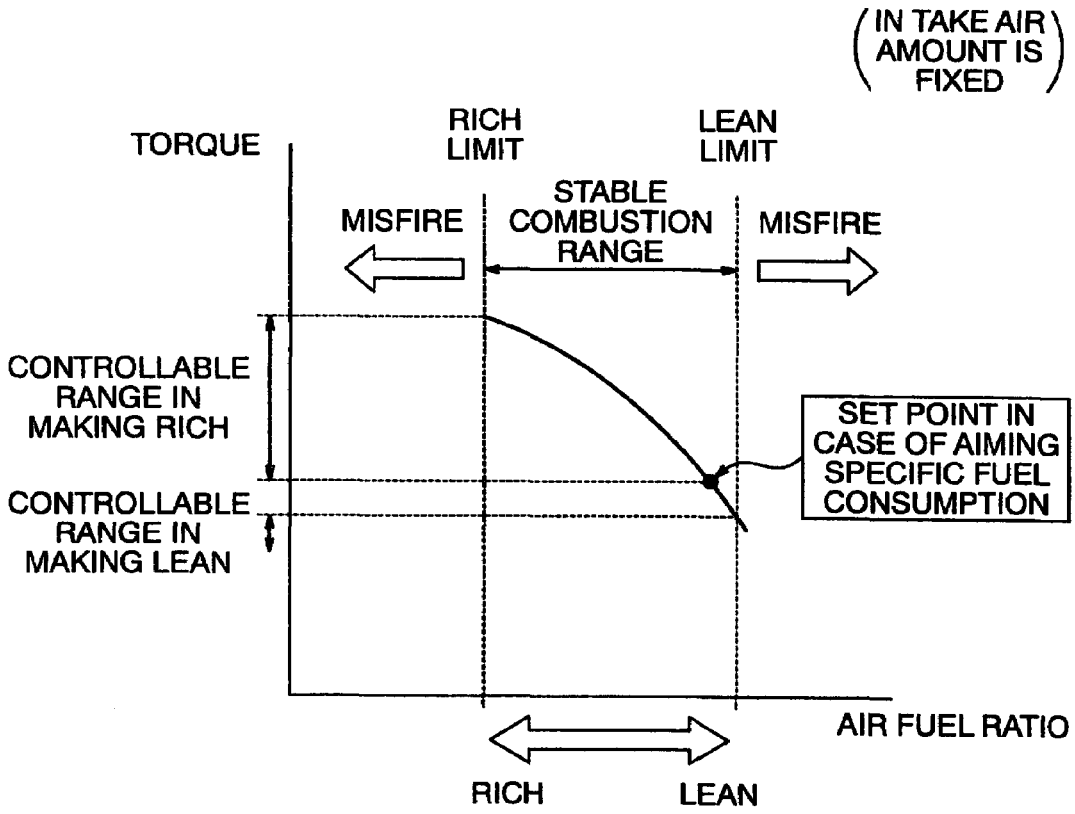
FIG. 11 is a view showing a relation between an air fuel ratio and a torque (in which an intake air amount is constant) in a stratified combustion.

In this case, it is necessary to apply a limit to the changed fuel amount so that it is not over the combustion limit as shown in FIG. 11, for the purpose of preventing the combustion state from being deteriorated. Further, it is possible to replace the fuel compensation amount by the torque obtained by the external apparatus such as the motor or the like so as to compensate.

Figure 8:
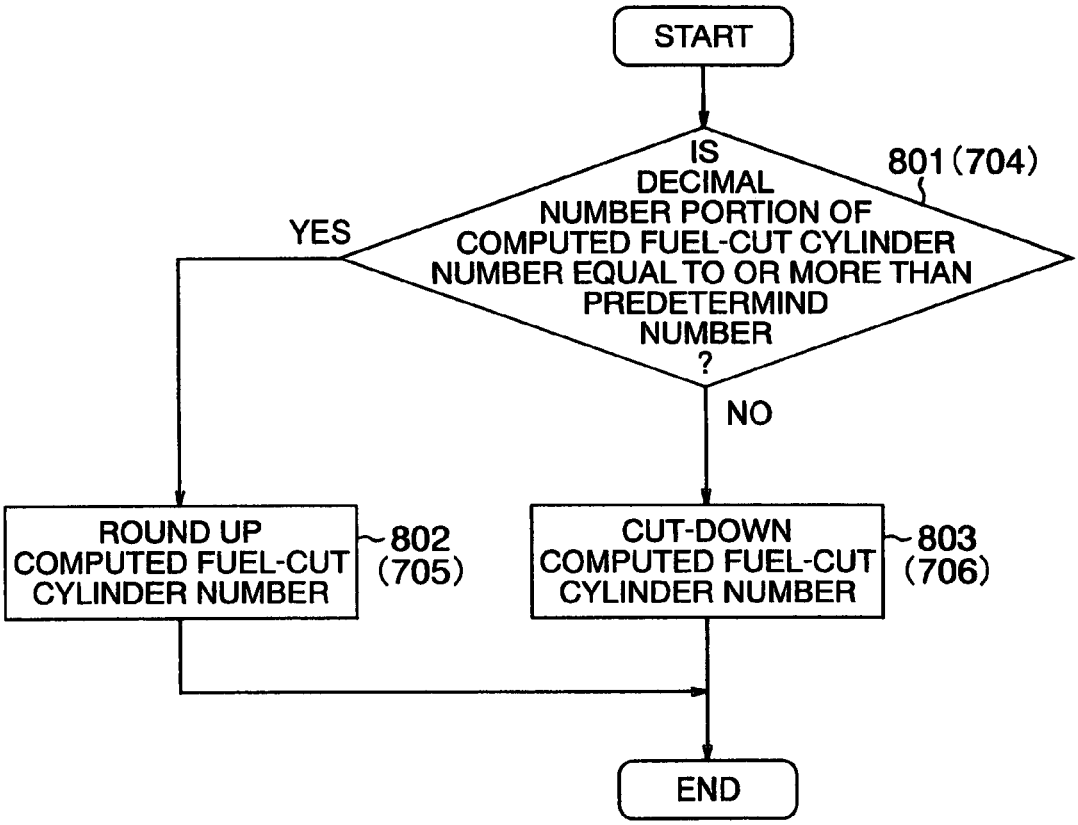
FIG. 8 is a control flow chart of a particular first embodiment of a fuel-cut cylinder number selecting computation in a step 704 in FIG. 7.

FIG. 8 shows a control flow chart of the control apparatus of the internal combustion engine in accordance with the second embodiment of the present invention, and shows a control flow of a particular first embodiment of the fuel cut cylinder number selecting computation in the step 704 in FIG. 7.

In a step 801 (704), it is judged whether a decimal number part of the fuel cut cylinder number computed in the step 702 (402) in FIG. 7 is equal to or more than a predetermined value or equal to or less than the predetermined value. In order to reduce the fuel injection compensation amount in the operating cylinders, in the case that it is equal to or more than the predetermined value, the fuel cut of the cylinder number obtained by rounding up the fuel cut cylinder number computed in the step 702 (402) is executed so as to increase the fuel injection amount of the operating cylinders. Further, in the case that it is equal to or less than the predetermined value, the fuel cut of the cylinder number obtained by cutting down the fuel cut cylinder number computed in the step 702 (402) is executed so as to reduce the fuel injection amount of the operating cylinders. The predetermined number is determined on the basis of the operating state and the range of the combustion stability.

Figure 9:
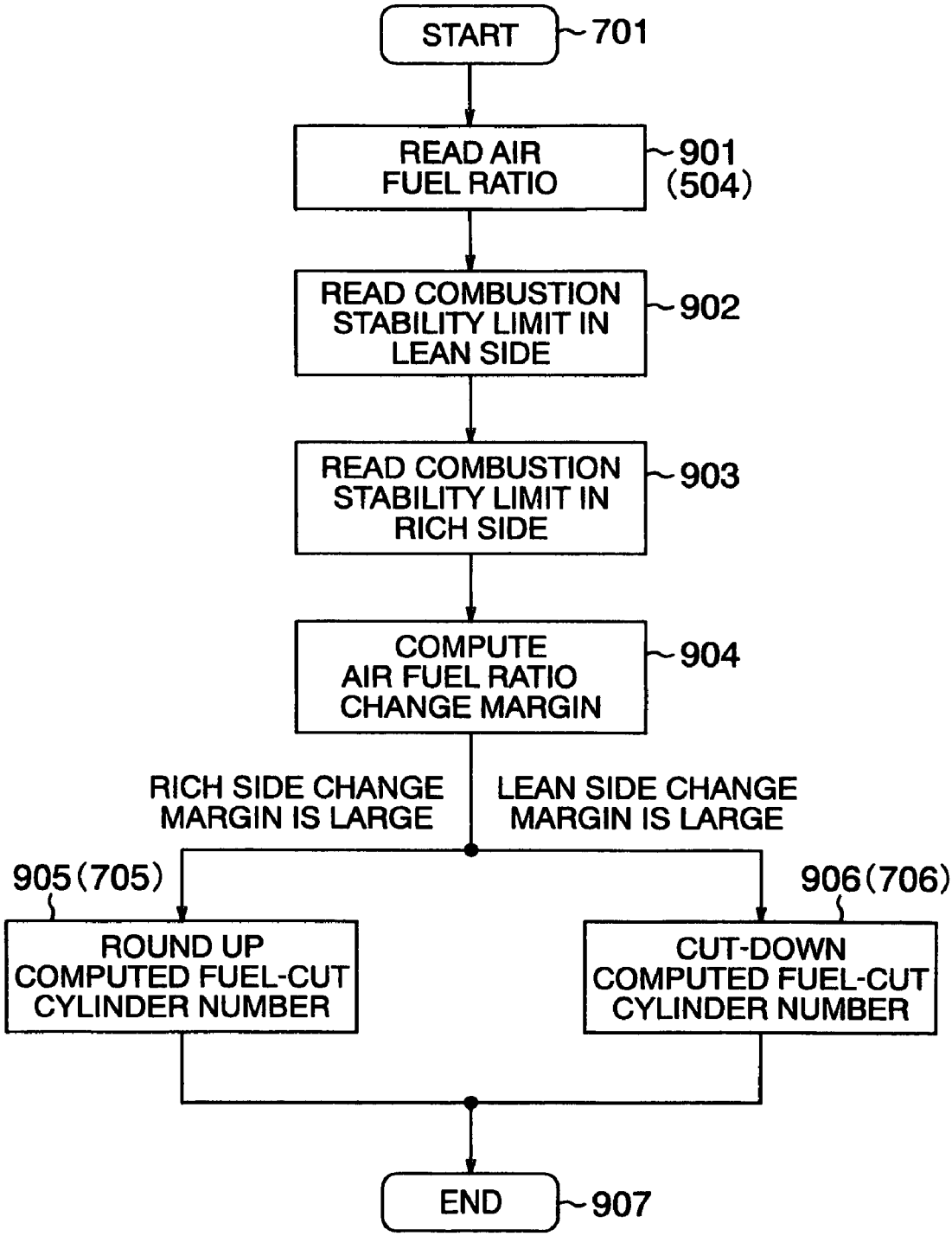
FIG. 9 is a control flow chart of a particular second embodiment of the fuel-cut cylinder number selecting computation in the step 704 in FIG. 7.
Figure 10:
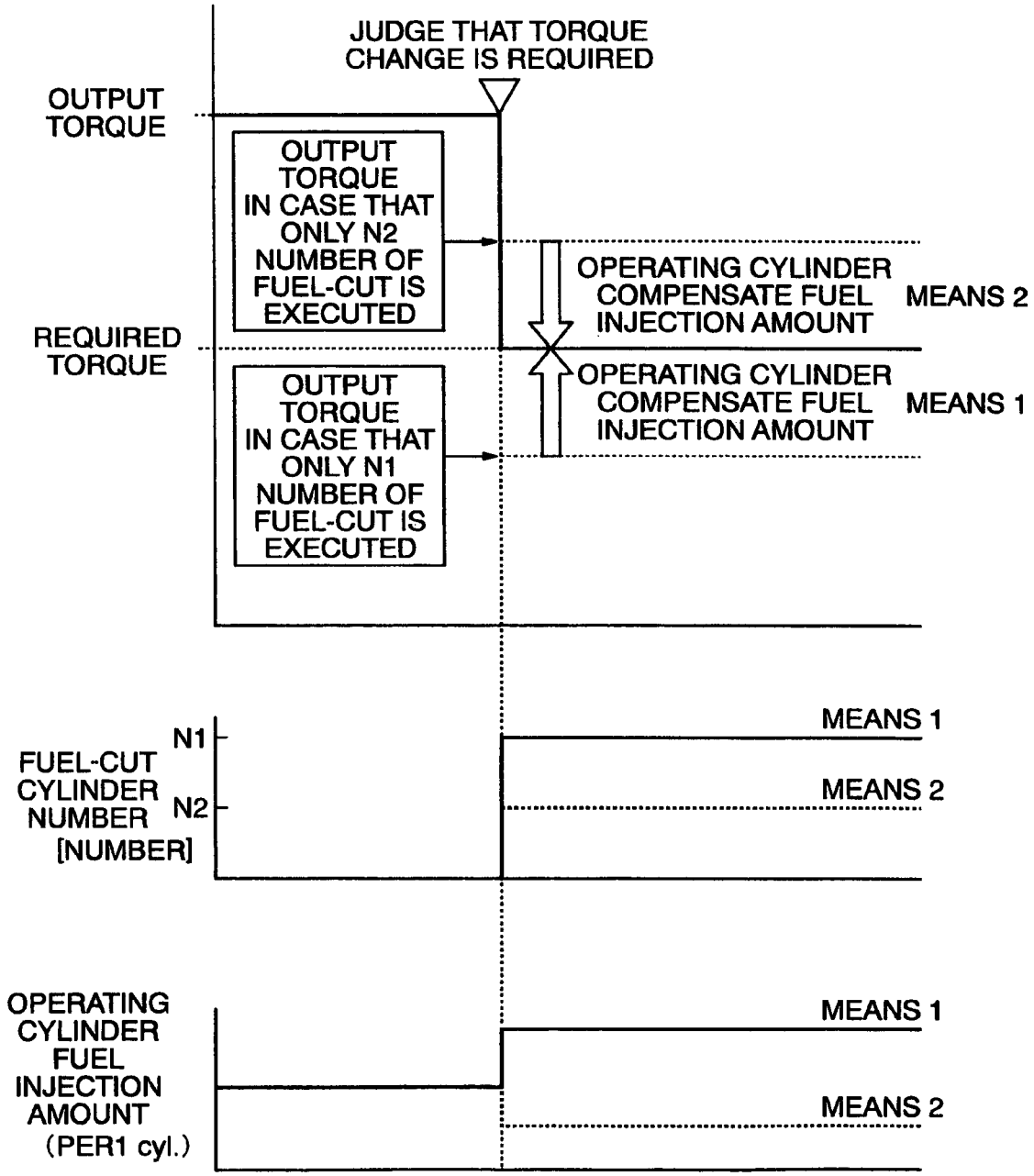
FIG. 10 is a time chart of the control apparatus of the internal combustion engine in accordance with the second embodiment of the present invention.

FIG. 9 shows a control flow chart of the control apparatus of the internal combustion engine in accordance with the second embodiment of the present invention, and shows a control flow of a particular second embodiment of the fuel cut cylinder number selecting computation in the step 704 in FIG. 7.

In a step 901 (504), the air fuel ratio is read, and in steps 902 and 903, a lean side combustion stability limit and a rich side combustion stability limit are read. The limit is searched on the basis of the state of the internal combustion engine, and is computed, for example, on the basis of a map.

In a step 904, an air fuel ratio changeable margin is computed by comparing the present air fuel ratio read in the step 901 (504) with the limit values computed in the steps 902 and 903. In order to obtain a stable combustion state, in the case that the changeable margin in a rich side is larger, the step goes to a step 905 (705), and the round-up of the fuel cut cylinder number computed in the step 905 (705) is executed. Further, in the case that the changeable margin in a lean side is larger, the step goes to a step 906 (706), and the fuel cut of the cylinder number obtained by cutting down the computed fuel cut cylinder number is executed in the step 906 (706). In this case, the air fuel ratio compared with the limit value in the step 904 may be a target air fuel ratio.

Further, it is possible to combine the second embodiment in FIG. 9 with the first embodiment in FIG. 8, or it is possible to select and compute the fuel cut cylinder number by using a map showing which the fuel cut cylinder number, for example, computed in the step 702 (402) should be rounded up or cut down, which is searched on the basis of the operating state of the internal combustion engine.

Figure 14:
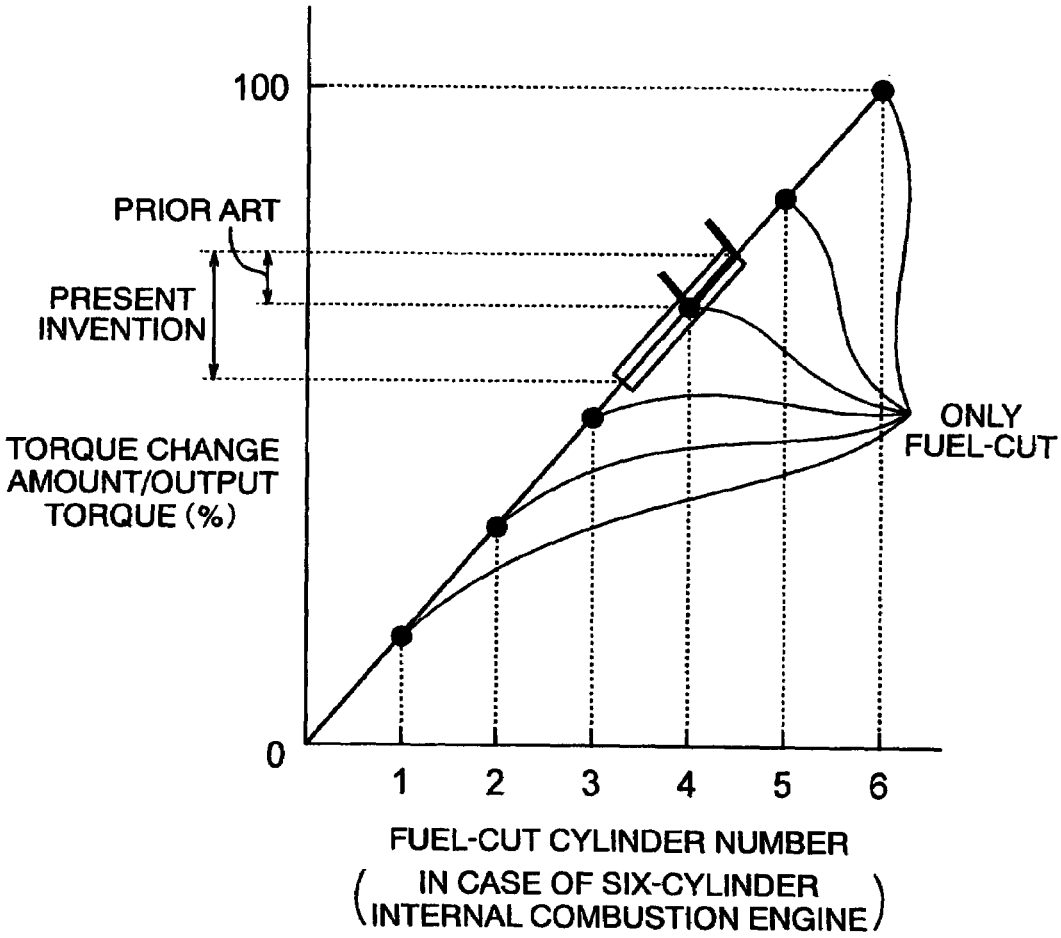
FIG. 14 is a view comparing effects of the control apparatus of the internal combustion engine in accordance with the embodiment of the present invention and a known control apparatus, on the basis of exemplification of a six-cylinder internal combustion engine executing a dilute combustion.

FIG. 14 shows an effect of the control apparatus of the internal combustion engine in accordance with the present invention in comparison with the known control apparatus, on the basis of the example of the six-cylinder internal combustion engine executing the dilute combustion. When the requirement of rapidly reducing the engine torque is applied, the engine torque of the internal combustion engine can be changed only at six fixed points during the period for which the combustion and explosion strokes of the respective cylinders in the engine pass all the cylinders, in the case of only the fuel-cut applied by the known control apparatus.

Further, in view of the case that the fuel cut is executed in four cylinders at a time when the torque reduction requirement is applied, as shown in FIG. 14, in accordance with the present invention in comparison with the prior art, since there are provided with a plurality of means comprising an increasing means for increasing a fuel having a large torque changeable width and a reducing means for reducing the fuel, and these two means are properly used in an optimum manner in correspondence to the operating state of the internal combustion engine, it is possible to expand the range for satisfying the torque change requirement while restricting the deterioration of the driving property and the exhaust gas. In this case, the torque changing means may execute by using a reduction of intake air amount together.

As mentioned above, the description is given in detail of two embodiments in accordance with the present invention, however, the present invention is not limited to the embodiments mentioned above, and can be variously changed in design within a range of the scope of the present invention described in claims.

In the embodiments mentioned above, no particular description is given of a portion at which an information of requiring the engine torque reduction and change, however, the portion may be generated on basis of any one of an information given from an external portion except the internal combustion engine, an information computed by the control apparatus, and the information given from the external portion except the internal combustion engine and the information computed within the control apparatus.

As is understood from the description mentioned above, the control apparatus of the internal combustion engine in accordance with the present invention has a plurality of means comprising the increasing means for increasing the fuel having a large torque changeable width and the reducing means for reducing the fuel, as the torque reducing means for reducing the torque of the internal combustion engine at a time when the engine torque reduction requirement is applied in correspondence to the state of the vehicle, and properly uses the means in correspondence to the state of the internal combustion engine in an optimum manner, in the multicylinder internal combustion engine executing the dilute combustion, whereby it is possible to satisfy the rapid torque change requirement while restricting the deterioration of the driving property and the exhaust gas.

It should be further understood by those skilled in the art that the foregoing description has been made on embodiments of the invention and that various changes and modifications may be made in the invention without departing from the spirit of the invention and the scope of the appended claims.

What is claimed is:

1. A control apparatus of an internal combustion engine comprising a control apparatus of a multicylinder engine executing a dilute combustion, wherein in the case that a requirement of reducing and changing an engine torque of said internal combustion engine is applied, the control apparatus executes a fuel cut of a predetermined number of cylinders, and controls so that a torque of operating cylinders except the cylinders executing said fuel cut becomes said required engine torque, wherein the number of cylinders to be cut the fuel is defined on the basis of a combustion stability limit.

2. A control apparatus of an internal combustion engine as claimed in claim 1, wherein the fuel cut of said at least one cylinder and the torque of said operating cylinders are controlled during a period for which combustion and expansion strokes of said respective cylinders pass through all the cylinders.

3. A control apparatus of an internal combustion engine as claimed in claim 1, wherein the reduction and change of said engine torque is executed on the basis of information applied from an external portion except the internal combustion engine.

4. A control apparatus of an internal combustion engine as claimed in claim 1, wherein the reduction and change of said engine torque is executed on the basis of information computed in said control apparatus.

5. A control apparatus of an internal combustion engine as claimed in claim 1, wherein the reduction and change of said engine torque is executed on the basis of an information applied from an external portion except the internal combustion engine and an information computed within said control apparatus.

6. A control apparatus of an internal combustion engine as claimed in claim 1, wherein said combustion stability limit is used for computing a changeable margin in a rich side or a lean side for obtaining a stable combustion state.

7. A control apparatus of an internal combustion engine as claimed in claim 6, wherein in the case that the rich side changeable margin is larger, the fuel cut cylinder number is increased, and in the case that the lean side changeable margin is larger, the fuel cut cylinder number is reduced.

8. A control apparatus of an internal combustion engine as claimed in claim 1, wherein the torque control of said operating cylinders is structured such as to increase and reduce the torque on the basis of the number of said cylinders in which the fuel cut is executed, and said required engine torque.

9. A control apparatus of an internal combustion engine as claimed in claim 8, wherein said control apparatus is provided with a roughly estimating means for roughly estimating the number of the cylinders in which the fuel cut is executed on the basis of a required value for reducing and changing the engine torque and an engine torque value before the reduction requirement is applied, a judging means for judging whether or not said number of the cylinders is an integral number and a computing means for computing the number of the cylinders in which the fuel is cut corresponding to an integral number value in the case that said judged number of the cylinders is not an integral number.

10. A control apparatus of an internal combustion engine as claimed in claim 9, wherein said computing means for computing the number of the cylinders in which the fuel is cut computes the number of the cylinders on the basis of the number of the cylinders roughly estimated by the cylinder number roughly estimating means or computes the number of the cylinders on the detected air fuel ratio.

11. A control apparatus of an internal combustion engine as claimed in claim 9, wherein said control means is provided with a torque control means for controlling the torque of said operating cylinders.

12. A control apparatus of an internal combustion engine as claimed in claim 1, wherein the number of said cylinders in which the fuel is cut is determined on the basis of a degree requirement at which said engine torque is reduced and changed.

13. A control apparatus of an internal combustion engine as claimed in claim 12, wherein said control apparatus is provided with a roughly estimating means for roughly estimating the number of the cylinders in which the fuel cut is executed on the basis of a required value for reducing and changing the engine torque and an engine torque value before the reduction requirement is applied, a judging means for judging whether or not said number of the cylinders is an integral number and a computing means for computing the number of the cylinders in which the fuel is cut corresponding to an integral number value in the case that said judged number of the cylinders is not an integral number.

14. A control apparatus of an internal combustion engine as claimed in claim 13, wherein said control means is provided with a torque control means for controlling the torque of said operating cylinders.

15. A control apparatus of an internal combustion engine as claimed in claim 13, wherein said computing means for computing the number of the cylinders in which the fuel is cut computes the number of the cylinders on the basis of the number of the cylinders roughly estimated by the cylinder number roughly estimating means or computes the number of the cylinders on the detected air fuel ratio.

16. A control apparatus of an internal combustion engine as claimed in claim 15, wherein said control means is provided with a torque control means for controlling the torque of said operating cylinders.

17. A control apparatus of an internal combustion engine as claimed in claim 1, wherein said control apparatus is provided with a roughly estimating means for roughly estimating the number of the cylinders in which the fuel cut is executed on the basis of a required value for reducing and changing the engine torque and an engine torque value before the reduction requirement is applied, a judging means for judging whether or not said number of the cylinders is an integral number and a computing means for computing the number of the cylinders in which the fuel is cut corresponding to an integral number value in the case that said judged number of the cylinders is not an integral number.

18. A control apparatus of an internal combustion engine as claimed in claim 17, wherein said computing means for computing the number of the cylinders in which the fuel is cut computes the number of the cylinders on the basis of the number of the cylinders roughly estimated by the cylinder number roughly estimating means or computes the number of the cylinders on the detected air fuel ratio.

19. A control apparatus of an internal combustion engine as claimed in claim 18, wherein said control means is provided with a torque control means for controlling the torque of said operating cylinders.

20. A control apparatus of an internal combustion engine as claimed in claim 17, wherein said control means is provided with a torque control means for controlling the torque of said operating cylinders.

21. A control apparatus of an internal combustion engine as claimed in claim 20, wherein said torque control means for controlling the torque of the operating cylinders changes and controls at least one of a fuel supply amount, a fuel injection timing and an ignition timing of said operating cylinders.

22. A control apparatus of an internal combustion engine as claimed in claim 21, wherein the fuel supply amount in said operating cylinders is limited on the basis of the air fuel ratio.

* * * * *